US005366568A

United States Patent [19]

Bruce

[11] Patent Number: 5,366,568

[45] Date of Patent: Nov. 22, 1994

[54] METHOD OF PRODUCING PRIMARILY TEMPERED MARTENSITE STEEL

[76] Inventor: Douglas G. Bruce, 2223 Fourth St., Perry, Iowa 50220

[21] Appl. No.: 135,718

[22] Filed: Oct. 13, 1993

[51] Int. Cl.[5] ..... C21D 8/00; C21D 9/00

[52] U.S. Cl. ..... 148/651; 148/654; 148/579

[58] Field of Search ..... 148/651, 654, 320, 579

[56] References Cited

U.S. PATENT DOCUMENTS 3,944,442 3/1976 Donachie ..... 148/651

FOREIGN PATENT DOCUMENTS 57-134515 8/1982 Japan ..... 148/651

*Primary Examiner*—Deborah Yee

*Attorney, Agent, or Firm*—Henderson & Sturm

[57] ABSTRACT

A method of producing primarily tempered martensite steel comprising the steps of cutting low carbon—high manganese steel into usable size pieces, shaping the pieces without surface fraction of the pieces, heating the pieces to approximately 1650° F. and quenching the pieces in water before the pieces cool below approximately 1475° F.

13 Claims, No Drawings

METHOD OF PRODUCING PRIMARILY TEMPERED MARTENSITE STEEL

TECHNICAL FIELD

The present invention relates generally to a method of producing primarily tempered martensite steel and more particularly to such a method which is faster and less expensive than previous methods of producing this material.

BACKGROUND ART

The traditional process for producing primarily tempered martensite steel begins with using a high carbon steel of above 1065. The steel is first cold worked by breaking parts into usable size since the steel is hard at this point, the tool life is short compared to if it could be worked as a low carbon steel. In the traditional process, it must then be hot formed in order to manipulate into the shape desired. Piercing and embossing must also be done while the steel is hot and this process causes undesirable burrs or the like which must later be removed in still another step. The steel must then enter a quenching medium at least above 1450° F. It is noted that the steel loses approximately 100° F. in temperature in each die that is used on it. The medium used is oil or synthetic water or a salt-type or cryogenic medium such as liquid nitrogen. These quenching mediums have a high cost. The medium also retains heat and breaks down or catches fire if it is not cooled adequately. This requires expensive equipment. Additionally, scale drops off into the oil, salt or synthetic base and this scale has oil absorbed in it. Consequently, there is a major problem of how to dispose of this scale since it cannot just be dumped anywhere.

After the steel has been quenched, it must be washed, after the quenching medium is drained off of the steel. The parts are then run through a tempering furnace at 800° F.–900° F. The parts are then cooled off with a water spray and then it is necessary to grind off all burrs that were caused during the piercing and embossing process. The parts can then be painted and packed.

One of the problems associated with the traditional process is that if the quenching medium could be water, then the scale could merely be disposed of by dumping it almost anywhere because it is not the type of scale that causes any harm to anything. It is only when the scale has oil, salt or synthetic base in it that disposal becomes a problem.

If a low carbon steel could be utilized instead of high carbon steel above 1065 at the beginning of the process, cutting it into usable sizes and shapes would increase the tool life substantially. Furthermore, if cold forming, instead of hot forming could be done, more savings could accrue. For example, no burrs would be formed if holes were put in during a cold forming process.

DISCLOSURE OF THE INVENTION

The present invention relates to a method of producing primarily tempered martensite steel comprising the steps of cutting low carbon—high manganese steel into usable size pieces, shaping the pieces without surface fracturing of the pieces, heating the pieces to approximately 1600° F.–1650° F. and quenching the pieces in water before the pieces cool below approximately 1525° F.–1475° F.

An object of the present invention is to be able to produce primarily tempered martensite quicker and more economically.

Another object of the present invention is to provide a process which uses only water for quick quenching which reduces the cost.

A still further object of the present invention is to use water for the quenching medium because it does not need to be cooled down since it can never get above 212° F. and the water does not contaminate the scale so that the scale can be thrown away harmlessly with no cost to dispose of the scale.

A still further object of the present invention is to provide a method as referred to above which permits less tool wear because the parts can be cut into usable sizes and shapes in a steel with cold working as compared to trying to do this process for high carbon steel above 1065 as in the traditional process.

Other objects, advantages, and novel features of the present invention will become apparent from the following detailed description of the invention when considered in conjunction with the accompanying drawings.

BEST MODE FOR CARRYING OUT THE INVENTION

The process of the present invention begins with raw steel in any configuration. This steel typically comes in a sheet or bar form. The steel used as the starting material in this process has carbon present in the range of 0.20–0.35 weight percent, manganese present in the range of 1.30–1.65 weight percent, sulfur present in an amount not to exceed 0.015 weight percent, and phosphorus present in an amount not to exceed 0.015 weight percent. The first part of the process includes cold working by cutting the steel into usable sizes and shapes. By using this process on steel having a carbon content ranging from 0.20–0.35 weight percent, the tool life is increased substantially as compared to performing this process on high carbon steel as in the conventional or traditional process disclosed above.

Then with either a cold or hot forming process, the pieces are shaped or formed without surface fracturing of the material. This can be done automatically or by hand. Holes are formed in the product and the product can be embossed at the same time in either a hot or cold process.

The pieces are then heated to approximately 1600° F.–1650° F. They must then enter the quenching medium which is water at 1525° F.–1475° which is above the martensite curve start temperature. The advantages of using a water quenching medium are low cost and rapid heat transfer. The water is not a contaminate. Water does not need to be cooled down because it cannot get above 212° F. The scale will fall into the water but then this water and scale can merely be drained off and thrown away since it is harmless as compared to oil, salt or synthetic bases which are contaminates. Consequently, there is no cost to dispose of the scale. The time lapse between the heating step and the quenching step should be five to fifteen seconds, depending upon the size of the pieces. Larger sizes can wait slightly longer. For most processes, seven seconds is optimum.

The quenching process is the last step necessary in this invention. Since the parts are pre-shaped in the process, it can all be done continuously and no one needs to handle the parts. There is no grinding because there are no burrs if a cold forming process is used.

Consequently, after these steps, the pieces can merely be painted and packed.

This permits the parts to be run faster, taking about half of the steps out of the traditional process. There is less tool wear and there is nothing to contaminate the environment since only water is used as a quenching medium. Consequently, there is only steam. A float valve can be used to keep the watering tank at the required level.

Obviously, many modifications and variations of the present invention are possible in light of the above teachings. It is therefore to be understood that, within the scope of the appended claims, the invention may be practiced otherwise than as specifically described.

I claim:

1. A method of producing primarily tempered martensite steel comprising:

heating steel to approximately 1650° F., the steel including carbon present in the range of 0.20–0.35 weight percent, manganese present in the range of 1.30–1.65 weight percent, sulfur present in an amount not to exceed 0.015 weight percent, and phosphorus present in an amount not to exceed 0.015 weight percent; and quenching the steel in water before it cools below approximately 1475° F.

2. The method of claim 1 including the following steps before the heating step:

cutting the steel into useable sized pieces; and shaping the pieces without surface fracturing of the pieces.

3. The method of claim 2 including forming holes in the pieces between the steps of shaping and heating.

4. The method of claim 3 wherein the hole forming comprises punching of the holes.

5. The method of claim 2 including the step of embossing the pieces between or with the steps of shaping and heating.

6. The method of claim 2 wherein said cutting step is done while the steel is at approximately ambient temperature.

7. The method of claim 2 wherein said shaping step includes the step of heating the pieces whereby the shaping is done by a hot forming process.

8. The method of claim 2 wherein said shaping step is done while the pieces are at ambient temperature whereby the shaping is done by cold forming.

9. The method of claim 1 wherein the time between the steps of heating and quenching does not exceed fifteen seconds.

10. The method of claim 1 wherein the time between the steps of heating and quenching is in the range of five to fifteen seconds.

11. The method of claim 1 wherein the time between the steps of heating and quenching is approximately seven seconds.

12. The method of claim 1 including the step of painting said pieces after quenching step and before any tempering can be done.

13. A method of producing primarily tempered martensite steel consisting of the steps of:

cutting steel into useable sized pieces, the steel including carbon present in the range of 0.20–0.35 weight percent, manganese present in the range of 1.30–1.65 weight percent, sulfur present in an amount not to exceed 0.015 weight percent, and phosphorus present in an amount not to exceed 0.015 weight percent;

shaping the pieces without surface fracturing of the pieces;

heating the pieces to approximately 1650° F.; and quenching the pieces in water before the pieces cool below approximately 1475° F.

* * * * *